US005465877A

United States Patent [19]

Bell et al.

[11] Patent Number: 5,465,877

[45] Date of Patent: Nov. 14, 1995

[54] ADJUSTABLE STROKE PUMP DISPENSER

[75] Inventors: Ronald F. Bell, Uniontown; J. Christopher Wysocki, Stow, both of Ohio

[73] Assignee: GOJO Industries, Inc., Cuyahoga Falls, Ohio

[21] Appl. No.: 188,694

[22] Filed: Jan. 31, 1994

Related U.S. Application Data

[62] Division of Ser. No. 941,726, Sep. 8, 1992, abandoned.

[51] Int. Cl.[6] ..... B65D 35/28; B67D 5/06

[52] U.S. Cl. ..... 222/181.2; 222/207; 222/309

[58] Field of Search ..... 222/206–214, 222/309, 181, 185, 181.3

[56] References Cited

U.S. PATENT DOCUMENTS

| | | | |
|---|---|---|---|
| 4,098,434 | 7/1978 | Uhlig | 222/309 X |
| 4,130,224 | 12/1978 | Norman et al. | 222/214 X |
| 4,226,342 | 10/1980 | Laauwe | 222/494 |
| 4,238,056 | 12/1980 | Tucker et al. | 222/309 X |
| 4,478,356 | 10/1984 | Roggenburg, Jr. et al. | 222/94 |
| 4,570,827 | 2/1986 | Roggenburg, Jr. et al. | 222/95 |
| 4,621,749 | 11/1986 | Kanfer | 222/153 |
| 4,634,022 | 1/1987 | O'Halloran et al. | 222/95 |
| 4,667,854 | 5/1987 | McDermott et al. | 222/214 X |
| 4,895,276 | 1/1990 | Maldonado | 222/214 X |
| 4,961,508 | 10/1990 | Weimer et al. | 222/214 X |
| 4,974,754 | 12/1990 | Wirz | 222/309 X |
| 5,033,657 | 7/1991 | Whittington | 222/309 |
| 5,102,015 | 4/1992 | Barnard et al. | 222/214 X |

*Primary Examiner*—Kevin P. Shaver
*Attorney, Agent, or Firm*—Reese Taylor

[57] ABSTRACT

A dispenser for dispensing fluid material from a replaceable container received within the dispenser. The dispenser includes a cover attached to a base mounting plate for movement longitudinally and pivotally with respect thereto and into and out of covering relationship therewith and a latch carried by the base mounting plate and movable into and out of locking engagement with the cover in response to actuation of a lever easily accessible in the closed condition. The cover has a large sight window occupying a substantial portion of its surface and enabling a substantial portion of one face of the container to be viewed when the cover is closed. Material is dispensed by actuating a pressure bar and an adjustable stop is provided to selectively vary the range of movement of the pressure bar and the amount of material dispensed.

10 Claims, 6 Drawing Sheets

ADJUSTABLE STROKE PUMP DISPENSER

This application is a divisional application of Ser. No. 941,726, filed Sep. 8, 1992, now abandoned.

RELATED PATENT APPLICATIONS

None.

BACKGROUND OF THE INVENTION

This invention relates in general to wall-mounted dispensers for dispensing soap or other similar products and relates in particular to an improved cover locking apparatus and dosage control means for such a dispenser as well as an improved sight window in the cover.

DESCRIPTION OF THE PRIOR ART

There are many dispensers known to the art for dispensing soap or other viscous material. More particularly, there are many dispensers of the "bag-in-box" type in which the soap or other material is contained in a flexible bag which, in turn, is carried in a box. The box is removably received within the dispenser which has a wall mounting plate and a cover swingable between an open and a closed position for access to the interior of the dispenser.

Bags of this type include a tube or other dispensing means which is then freed from its shipping and storage position within the box by removing a tear strip on the box. Once freed from the box, the dispensing means depends from it and is seated in suitable positioning fixtures in the dispenser and is actuated by movement of a push or pressure bar which either collapses the tube or activates a bellows-type dispensing pump so as to dispense a measured amount of soap onto the hand of the user.

These devices generally include, as previously noted, a vertically disposed base or mounting plate which can be secured to a wall or other vertical surface and which includes a shelf or platform upon which the box may rest with the collapsible tube or dispensing nozzle depending downwardly therefrom. These dispensers generally also include a cover which is hinged or otherwise affixed to the mounting plate and which is swingable between an open and closed position so as to permit replacement of the soap supply.

These dispensers also include some means for either collapsing the tube or activating a bellows-type pump so as to dispense the material. In variations of these dispensers, some of these pressure members or pressure bars are mounted alternatively on the mounting plate or on the cover and, upon actuation of the same, the soap may be dispensed from the bag through suitable valving means and nozzles.

Since, in many instances, dispensers of this general type are mounted in public facilities, it is desirable to provide locking means which securely hold the cover in place, but which are readily accessible and operable when it is necessary to open the cover to refill the dispenser. It is thus a bit of a dilemma in that it is desirable to make these locking means easy to operate by maintenance personnel but, by the same token, to disguise or conceal the actuating means therefor so as to at least minimize and discourage vandalism by unauthorized personnel.

An example of a dispenser of the type generally referred to herein and one form of locking mechanism of this general type can be seen in Kanfer U.S. Pat. No. 4,621,749.

While locking means of this general type are essentially effective for the purposes for which they are designed, it is believed that further improvements can be made therein wherein a single hand operation is facilitated.

Another feature of dispensers of this type is the provision of a sight window in the cover which permits some visual access to the interior of the container. An example can be seen in the Kanfer patent just referred to. These windows are generally provided to permit one to observe the soap level and evaluate the need for refilling the dispenser as well as to observe the brand or type of soap being dispensed.

Thus, many of these dispensers are labeled with such legends as "lotion soap," "heavy duty soap," etc., and most are capable of dispensing a variety of such products. While the dispenser itself could be labeled to this effect, such an approach obviously reduces the flexibility of use of the dispenser. Therefore, unless the user can observe a significant portion of the box, he or she has no assurance of the contents of the dispenser. The conventional sight windows are generally too small to permit such viewing.

Likewise, the dispensers commonly bear the trademark or corporate identifier of the manufacturer. However, the boxes containing the soap are, to a large extent, interchangeable, so that, unless one can observe the box, the user also has no assurance regarding the origin of the contents.

Therefore, it is believed that improvements can be made in this aspect of the dispenser as well.

Finally, it may be desirable to alter the dose dispensed upon each operational stroke of the pressure member. While this can be done by varying the dimensions of the tube, it is believed that a more versatile dispenser can be produced by providing a control member which is a normal component of the dispenser combination and which can be adjusted to modify the stroke of the pressure member and, hence, the dose.

SUMMARY OF THE INVENTION

It is, accordingly, an object of this invention to provide a self-contained locking apparatus for securing the cover of a dispenser of this nature to its mounting plate. To that end, it has been found that such a locking apparatus can be achieved by providing a latch on the base mounting plate which is movable into and out of engagement with the cover and an eccentric pivot attachment between the cover and the mounting plate which permits the cover to move longitudinally relative to the mounting plate when the latch is disengaged by, for example, grasping the device between the thumb and finger of one hand and squeezing.

It has further been found that secondary locking means may be provided on the upper ends of the cover and mounting plate which are movable longitudinally into and out of locking engagement in response to such longitudinal movement of the cover and permit the cover to swing out and away from the mounting plate for access to the interior.

It is a still further object of this invention to provide improved visual access to the interior of the dispenser when the cover is in closed position. To that end, it has been found that the front face of the cover may be provided, over a substantial portion of its surface, with a recessed, transparent sheet whereby substantially all of the interior contents of the dispenser may be readily observed but are protected against damage.

It is a still further object of this invention to provide an adjustable control member between the pressure member and the body of the base plate to selectively modify the stroke of the pressure member and, hence, the dosage emitted on each stroke.

Accordingly, production of an improved dispensing apparatus of the character described becomes the principal object of this invention with other objects thereof becoming apparent upon a reading of the following brief specification considered and interpreted in view of the accompanying drawings.

BRIEF DESCRIPTION OF THE PREFERRED EMBODIMENTS

Figure 1:
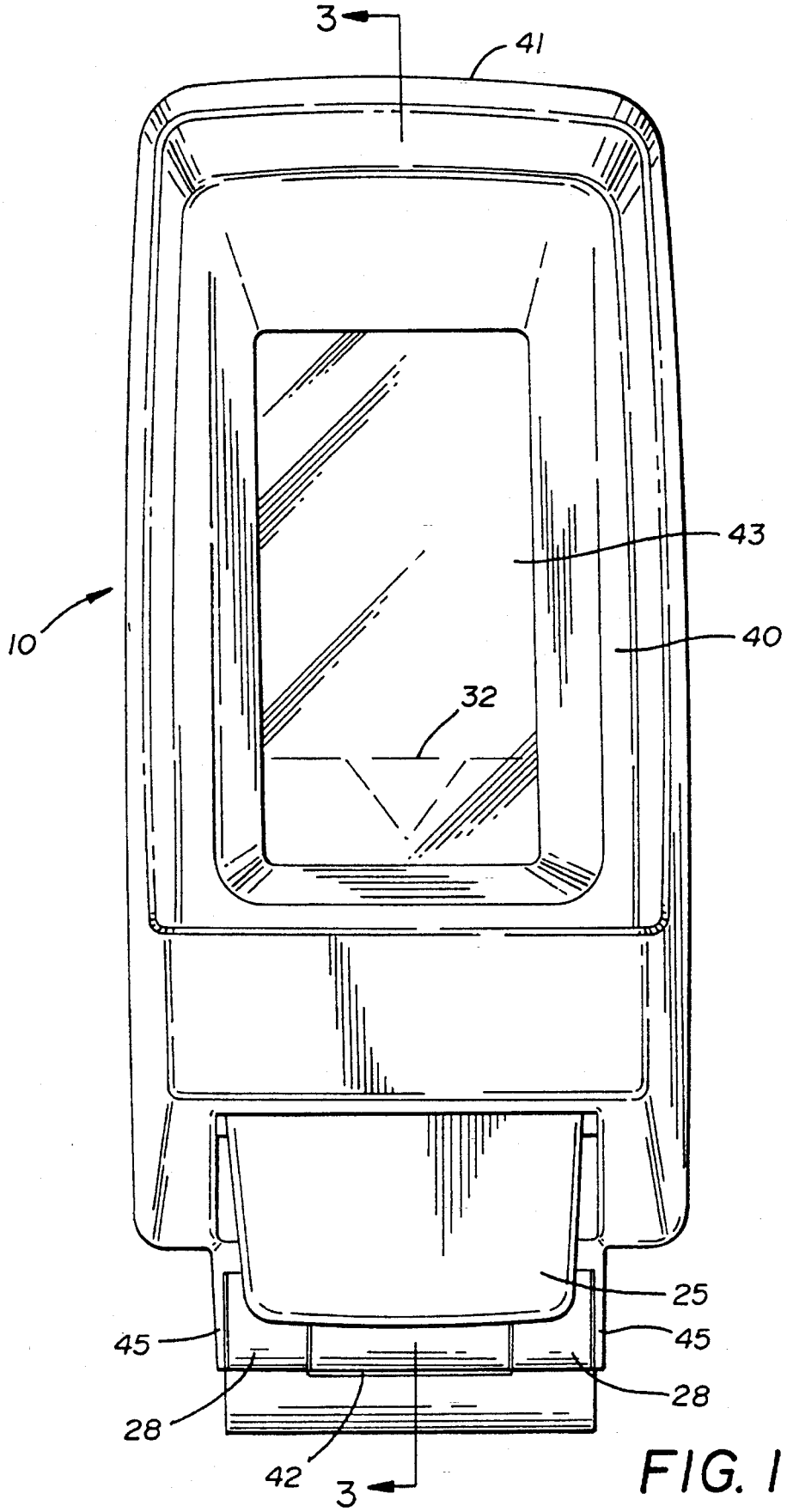
FIG. 1 is an elevational view of the improved dispenser in closed position.
Figure 2:
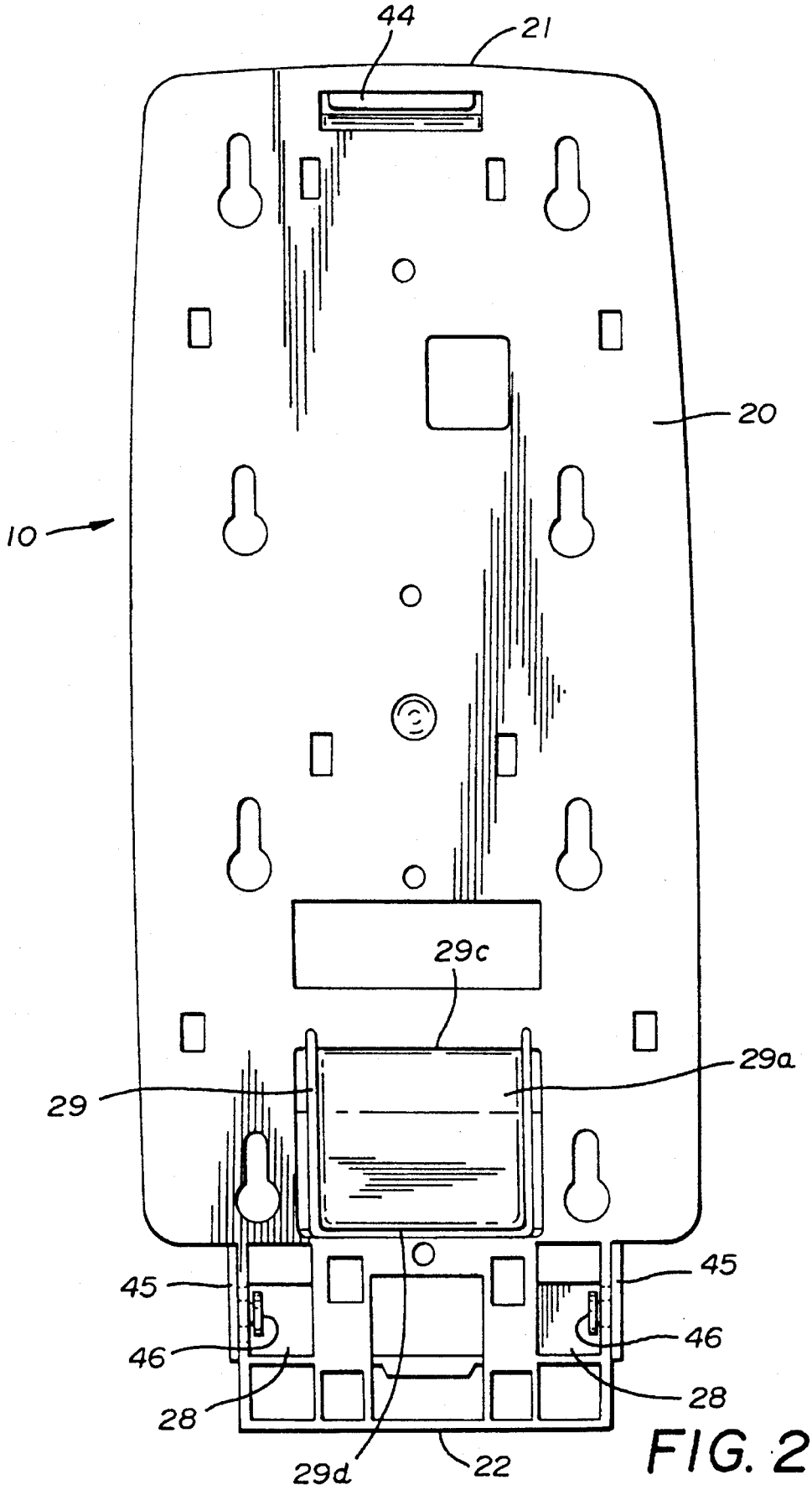
FIG. 2 is an elevational view taken from the back of FIG. 1 and partially illustrating the locking apparatus.

Referring first then to FIGS. 1 and 2 of the drawings, it will be seen that the dispenser, generally indicated by the numeral 10, includes a base mounting plate 20 and a cover 40. The base mounting plate 20 has upper and lower ends 21,22, while the cover has upper and lower ends 41,42, with the cover being mounted adjacent its lower end 42 in swingable and pivotable relationship to the plate 20, as will be described in greater detail below. Suffice it to say at this point that the cover 40 is capable of movement between open and closed positions with respect to mounting plate 20.

Referring next then to FIGS. 1, 2, 3 and 4 of the drawings, it will be seen that the base mounting plate 20 has a projecting, top locking rib 23 which is spaced from mounting plate 20 to form a space 23*a* for receipt of a mating cover locking rib 44 on the cover 40. Particularly referring to FIGS. 3 and 4 of the drawings, it will be seen how, in FIG. 3, the cover locking rib 44 is received within the space 23*a* behind the base locking rib 23 of the base mounting plate 20 in the locked position.

Figure 4:
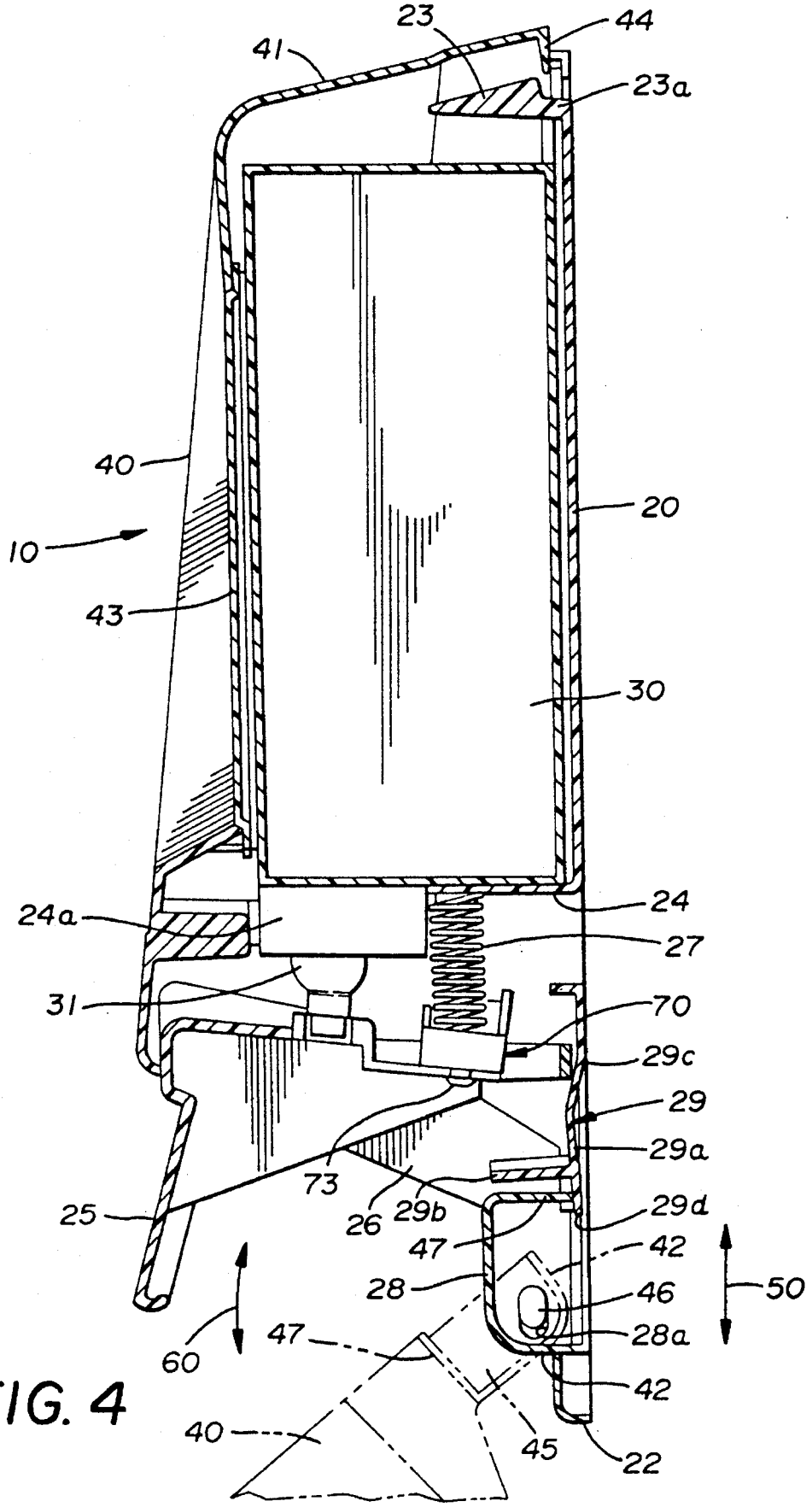
FIG. 4 is a sectional view similar to FIG. 3 showing the apparatus in the unlocked position.
Figure 5:
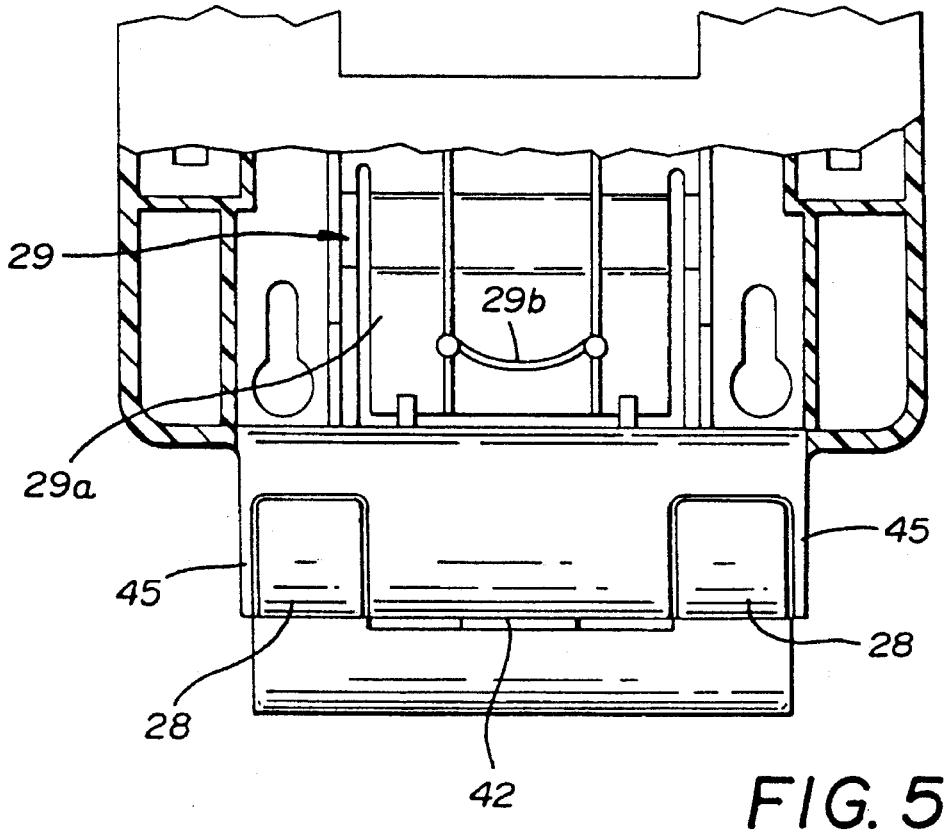
FIG. 5 is a sectional view taken along the line 5—5 of FIG. 3 showing the locking apparatus in detail.
Figure 6:
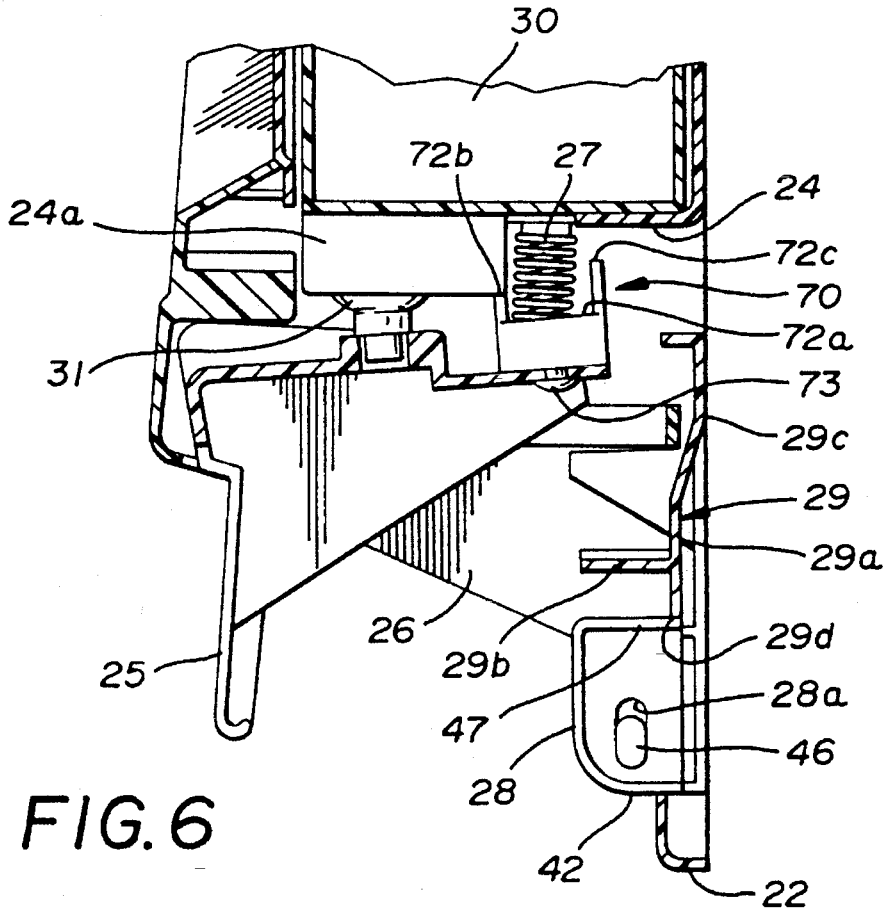
FIG. 6 is a partial elevational view showing the control member and the pressure member in fully actuated condition.

Movement of the cover locking rib 44 to the unlocked position, as illustrated in FIG. 4, will be described more fully below, but it will be appreciated that longitudinal movement of the cover 40 relatively of plate 20 will permit engagement and disengagement of these members.

Figure 3:
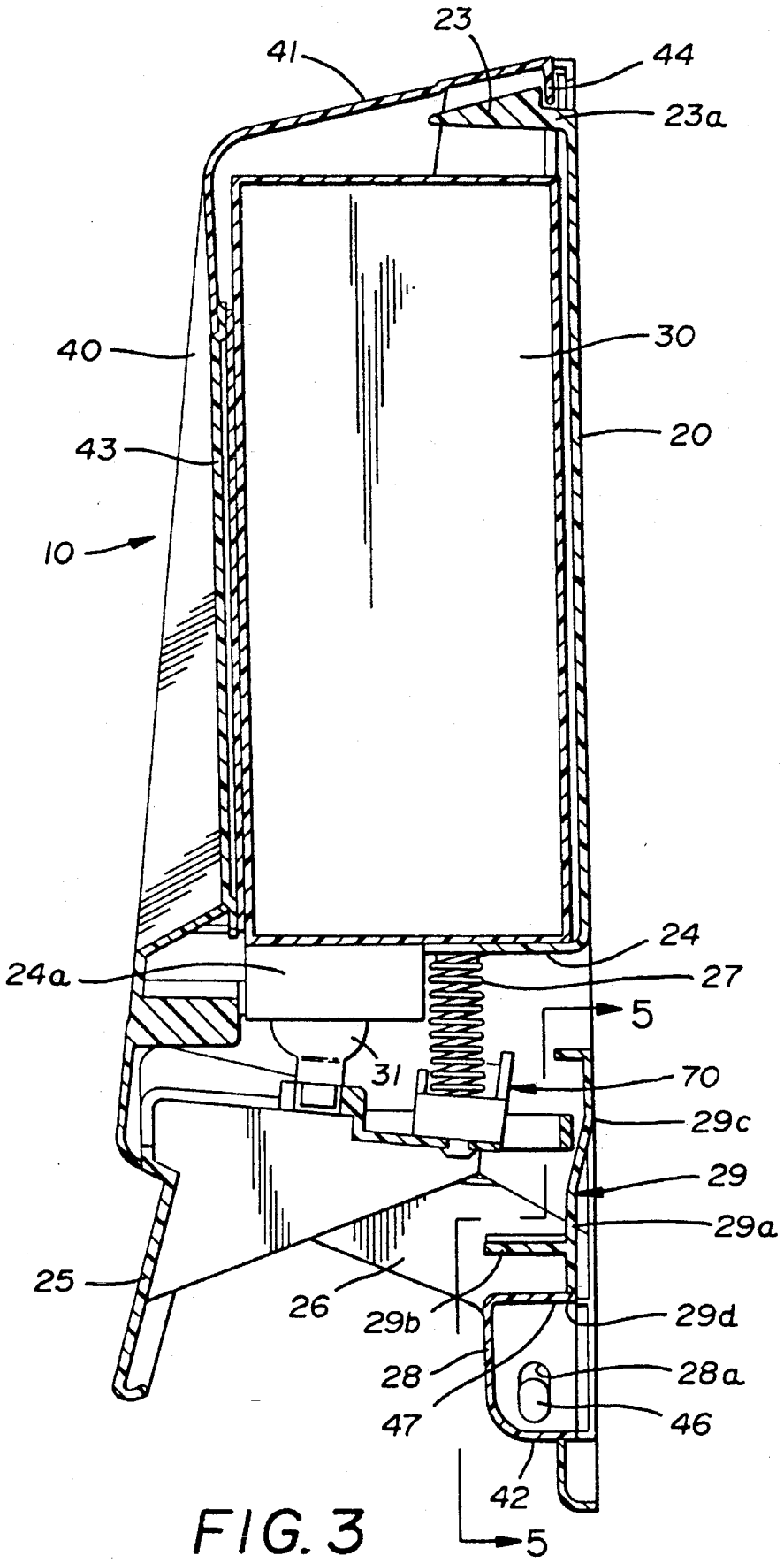
FIG. 3 is a sectional view taken along the line 3—3 of FIG. 1 showing the apparatus in the locked position.

Still referring then to FIGS. 3 and 4 of the drawings, it will be seen that the base mounting plate 20 also provides a box support shelf 24 which projects outwardly and presents a horizontal surface upon which the box 30, which contains the material to be dispensed, can rest.

In that regard, and as previously noted, generally a collapsible bag is filled with the soap, is received within the box 30, and has either a collapsible tube, a bellows-like pump or some other dispensing means accessible through a tear strip 32 in at least one face of the box. As will be described immediately below, this dispensing means is removed from the box 30 and moved into position for engagement with an actuating means such as a pressure bar.

In the form of the invention illustrated herein, such a pressure bar 25 is pivotally supported on pivot support arms 26,26 projecting from the back support plate 20 and is swingable to and from the back plate. Optionally, a spring 27 rests against the lower surface of the box support shelf 24 and has one end received against the underside of box support shelf 24 and its opposed end received in control member 70 on the pressure bar 25, with the spring normally urging the pressure bar 25 to the relaxed or non-dispensing position illustrated in FIG. 3 of the drawings.

It will also be noted that, in the form of the invention illustrated herein, the dispensing means includes a bellows-type pump 31 depending from the box 30 and that, upon movement of the pressure bar 25 against the force of the spring 27 and toward the base mounting plate 20, pump 31 would be collapsed and would dispense a measured amount of material. It is believed that this feature per se does not form a particular part of the present invention and, therefore, will not be described in any greater detail herein.

It will be noted that spring 27 is optional and that the combination is operable without it inasmuch as the tube or, in this instance, the bellows valve 31 will return the pressure member 25 to its at rest position as it fills. However, use of the spring accelerates the recharging step and facilitates use of the dispenser.

Referring next to FIGS. 1 through 5 of the drawings, it will be seen that the base mounting plate also includes a pair of opposed pivot boxes 28,28 for pivotal interconnection with pivot pins 46,46 of the cover 40, as will be described. These boxes each include an elongate opening 28*a* which, upon disengagement of the latch means, as will be described below, permits longitudinal movement of the cover 40 with respect to the plate 20 in the direction of the arrow 50 (see FIG. 4).

With regard then to the latch means, it will be seen from FIGS. 2, 3, 4 and 5 that these means are generally indicated by the numeral 29 and comprise a latch body 29*a* which is either integral with the base plate 20 or secured thereto by known means. This latch has a flex point or hinge line 29*c* and a projecting actuating lever 29*b* which preferably has an arcuate contour for ease of use as will become apparent. As can be seen from FIGS. 1 and 3, for example, the actuating lever 29*b* is not visible when the cover 40 is in the closed position, but yet is readily accessible by inserting one's thumb behind the pressure bar 25 and engaging it.

The latch body 29*a* also has an engagement end or surface 29*d* which engages the cover 40, as will be described. At this point, however, it is sufficient to note that a comparison of FIGS. 3 and 4 will show how pressure on the lever 29*b* will flex the latch member 29 rearwardly with respect to the mounting plate 20. In that regard, it will be seen that, for example, engaging actuating lever 29*b* with the thumb and bottom end 42 of the cover with the fingers and squeezing will disengage latch 29.

Referring then to FIGS. 1, 3 and 4 for a further description of the cover, as previously noted, the cover has top and bottom ends 41,42 and a recessed, transparent sight window 43 which, in this form of the invention, occupies a substantial area of the front face of the cover 40 and enables one to view a substantial portion of one face of the box 30 and some of the bag 32 when the cover is in the closed position.

Thus, as previously mentioned, this large sight window not only permits improved visual access to the bag 32 to observe the soap level, but permits the user to read any material printed on the face of box 30 such as contents, origin, etc.

The cover 40 also has a cover locking rib 44, as has been mentioned, which depends from the top end 41 thereof and, as can be seen in FIG. 3 of the drawings, when the cover is in the closed and locked position, this locking rib 44 is received within the space 23*a* between the base plate rib 23 of the base mounting plate 20 and the base mounting plate itself. Likewise, as can be seen from FIG. 4, when the cover is moved longitudinally in the direction of the arrow 50, the top locking rib 44 moves out of engagement with the top locking rib 23 of the base mounting plate 20, thereby enabling the cover to swing to the open position in the direction of arrow 60, as illustrated in broken lines in FIG. 4, so that access to the box 30 for replacement thereof is quite easy.

Still referring to FIGS. 1, 2, 4 and 5, it will be seen that pivot support legs 45,45 depend from the lower end 42 of the cover and carry pivot pins 46,46 which are received in the elongate slots or apertures 28*a*,28*a* of the support boxes 28,28 of the base mounting plate 20. It will be readily apparent that once the latch means 29 are released and the latch engagement edge 29*d* is moved out of contact with the engagement rib 47 of the cover 40, the nature of the slots 28*a*,28*a* permit movement in the direction of the arrow 50 so that the cover may be moved from the full line latched position of FIG. 3 to the full line unlatched position of FIG. 4. This then permits the cover 40 to be swung to the broken line open position of FIG. 4.

Turning next to FIGS. 3, 4, 6, 7 and 8 for consideration of control member 70, as has already been mentioned, in the form of the invention illustrated herein, soap is dispensed by moving pressure bar 25 toward base mounting plate 20 to activate bellows valve 31. Also as previously mentioned, one end of spring 27 is seated in control member 70.

Figure 8:
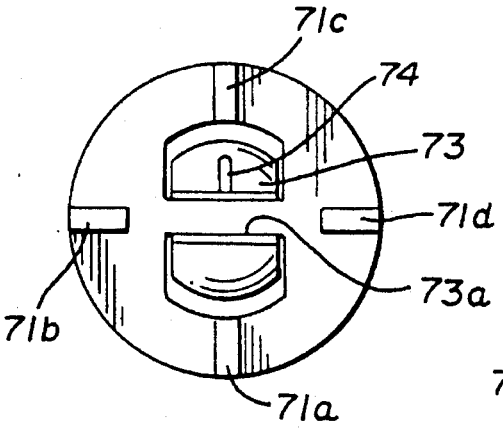
FIG. 8 is a bottom plan view of the control member taken along the line 8—8 of FIG. 7.
Figure 7:
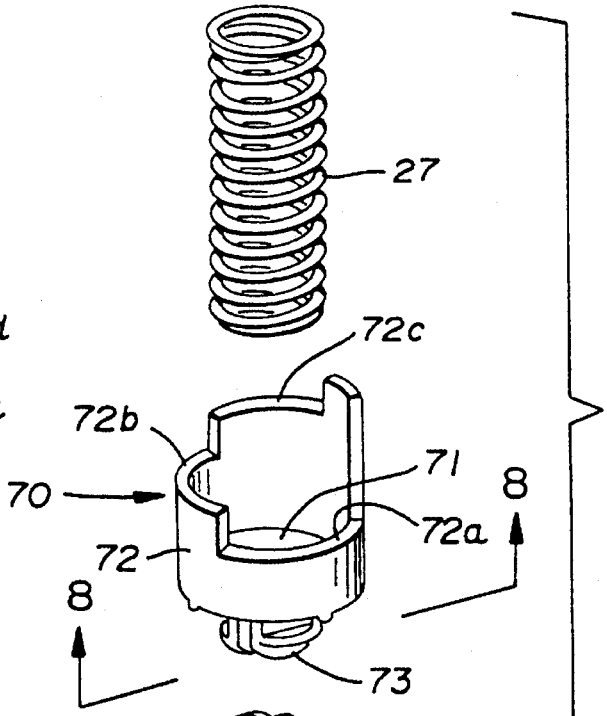
FIG. 7 is an exploded view of the pressure member and control member.
Figure 7:
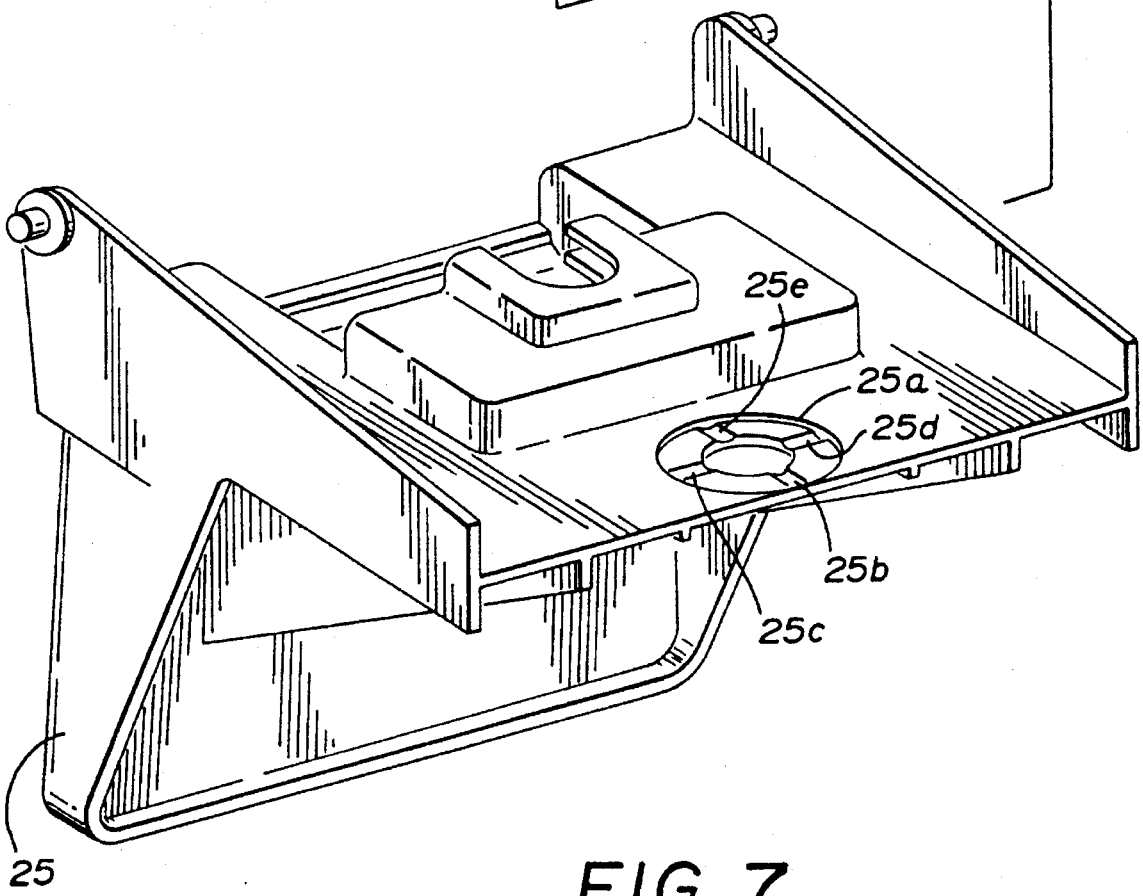

As can be seen particularly in FIGS. 7 and 8, control member 70 is a cylindrical piece having a bottom wall 71 for engagement with the end of spring 27 and an upstanding side wall 72 which is stepped so as to present three engagement surfaces 72*a*, 72*b* and 72*c*. As can be seen from FIG. 6, when the pressure bar 25 is depressed, engagement surface 72*b* ultimately comes into contact with the bottom of extension 24*a* of shelf 24 and further inward travel of pressure bar 25 is prevented. It will be clear that depending on which engagement surface is positioned toward pressure bar 25, greater or lesser travel and, thus, more or less soap will be dispensed.

Thus, control member 70 is adjustable. It is mounted in countersunk aperture 25*a* in the body of pressure bar 25 with adjustment knob 73 projecting therethrough so as to be accessible from beneath. This adjustment knob may be provided with a screw driver receiving slot 73*a* if desired.

The countersunk floor of aperture 25*a* has radially extending grooves 25*b*, 25*c*, 25*d* and 25*e* while the bottom of control member 70 has radial ribs 71*a*, 71*b*, 71*c* and 71*d* which can be seated in the grooves following adjustment. To that end, control member 70 can be adjusted by pushing it up against the force of spring 27 and rotating it until the desired engagement surface is positioned toward pressure bar 25. Releasing upward pressure will then permit spring 27 to seat control member 70 with the ribs and grooves in engagement. The combination of spring pressure and the rib and groove interlock thus prevents inadvertent movement of the control member 70 during operation of the dispenser 10.

Finally, it will be noted that an indicator rib 74 is provided on the bottom of control member 70 in alignment with lowermost engagement surface 72*a* as an indicia of the location of that surface.

While a full and complete description of the invention has been set forth in accordance with the dictates of the Patent Statutes, it should be understood that modifications can be resorted to without departing from the spirit hereof or the scope of the appended claims.

Thus, while the foregoing specification has referred to "soap," it will be readily appreciated that the inventive aspects of the present invention are not intended to be limited to dispensers for "soap" only.

Further, while control member 70 is illustrated and described as being mounted on pressure bar 25, it could easily be inverted and mounted on box support shaft 24 whereupon its operation in controlling movement of the pressure bar will be the same as previously described.

What is claimed is:

1. A dispenser of the type wherein material is dispensed through a collapsible dispensing member by engaging the dispensing member with a pressure member, comprising:

a) an adjustable control member disposed between the pressure member and a portion of the dispenser to control the range of movement of the pressure member relatively of the collapsible dispensing member during the dispensing operation;

b) said control member is carried by the pressure member; and c) the pressure member including an elongate unitary body pivotally mounted on the dispenser in engagement with the collapsible dispensing member, whereby the pressure member activates the collapsible dispensing member to dispense material upon the application of pressure thereto and returns the collapsible dispensing member to its starting position upon release of pressure on the pressure member.

2. The dispenser of claim 1 wherein said control member is carried on one end of the pressure member and adjustable from beneath the pressure member to selectively vary the range of movement of the pressure member relatively of the collapsible dispensing member during the dispensing operation.

3. The dispenser of claim 2 wherein said control member includes a rotatable stop having projections of varying heights for selective engagement with said portion of the dispenser.

4. A dispenser for dispensing fluid material from a container releasably receivable within the dispenser, comprising:

a) a base mounting plate including means for supporting the container;

b) a cover attached to said base mounting plate for movement longitudinally and pivotally with respect thereto into and out of covering relationship therewith;

c) latch means carried by said cover and said base mounting plate for releasably retaining said cover in covering relationship with said base mounting plate;

d) an elongate pressure member pivotally secured to the dispenser for movement toward and away from said base mounting plate to dispense material from said container; and e) means for selectively adjusting the range of movement of said pressure member, said means including an adjustable control member carried by one end of said pressure member for engagement with said means for supporting the container and being adjustable from beneath said pressure member.

5. The dispenser of claim 4 wherein said latch means include a latch hingedly carried by said base mounting plate and movable into and out of locking engagement with said cover.

6. The dispenser of claim 5 wherein said latch means includes a lever accessible from beneath said cover for moving said latch out of locking engagement with said cover.

7. The dispenser of claim 4 wherein said means for selectively adjusting the range of movement of said pressure member includes a control member carried by said pressure member and movable into engagement with said means for supporting the container when said pressure member is moved toward said base mounting plate.

8. The dispenser of claim 7 wherein said control member is adjustable from beneath said cover to vary the distance traveled by said pressure member before engagement between said control member and said portion of said base mounting plate.

9. The dispenser of claim 8 wherein said control member includes means to permit it to be releasably lockable in selected adjusted positions.

10. The dispenser of claim 4 wherein said cover includes a transparent window occupying a substantial area thereof whereby a substantial portion of the container may be observed when said cover is in covering relationship with said base mounting plate.

* * * * *

UNITED STATES PATENT AND TRADEMARK OFFICE

CERTIFICATE OF CORRECTION

PATENT NO. : 5,465,877
DATED : November 14, 1995
INVENTOR(S) : Ronald F. Bell, et al It is certified that error appears in the above-indentified patent and that said Letters Patent is hereby corrected as shown below:

On the title page, item [62], change "Division" to --Continuation--.

Signed and Sealed this

First Day of October, 1996

*Attest:*

Bruce Lehman

BRUCE LEHMAN

*Attesting Officer*

*Commissioner of Patents and Trademarks*